United States Patent [19]

Ohmori et al.

[11] Patent Number: 5,021,501

[45] Date of Patent: Jun. 4, 1991

[54] FLUORINE-CONTAINING WATER-REPELLENT OIL-REPELLENT COMPOSITION

[75] Inventors: Akira Ohmori, Ibaraki; Hiroshi Inukai, Settsu, both of Japan

[73] Assignee: Daikin Industries, Ltd., Osaka, Japan

[21] Appl. No.: 445,950

[22] Filed: Dec. 11, 1989

Related U.S. Application Data

[60] Continuation of Ser. No. 211,121, Jun. 21, 1988, abandoned, which is a division of Ser. No. 50,018, May 15, 1987, abandoned.

[30] Foreign Application Priority Data

May 28, 1986 [JP] Japan ..... 61-122920
Oct. 6, 1986 [JP] Japan ..... 61-238535

[51] Int. Cl.[5] ..... C08K 27/12

[52] U.S. Cl. ..... 524/544; 524/545; 524/546; 526/245

[58] Field of Search ..... 524/544, 545, 546; 526/245

[56] References Cited

U.S. PATENT DOCUMENTS 3,393,186 7/1968 Groves ..... 524/546
4,539,250 9/1985 Fujii et al. ..... 428/195

OTHER PUBLICATIONS

*Hawley's Condensed Chemical Dictionary* Eleventh Ed. p. 854.

Grant & Hackh's *Chemical Dictionary* Fifth Ed. p. 24.

*Primary Examiner*—Joseph L. Schofer
*Assistant Examiner*—Peter D. Mulcahy
*Attorney, Agent, or Firm*—Larson and Taylor

[57] ABSTRACT

The present invention provides a fluorine-containing water- and oil-repellent composition comprising a fluorine-containing acrylate represented by the formula:

$$CH_2{=}\underset{\underset{COO-Y-Rf}{|}}{C}-X \qquad (1)$$

wherein X is a fluorine atom or $-CFX^1X^2$ group (wherein $X^1$ and $X^2$ are the same or different and are each a hydrogen atom or fluorine atom), Y is alkylene having 1 to 3 carbon atoms, $-CH_2CH_2N(R)SO_2-$ group (wherein R is alkyl having 1 to 4 carbon atoms) or $-CH_2CH(OZ)CH_2-$ (wherein Z is a hydrogen atom or acetyl), and Rf is fluoroalkyl having 3 to 21 carbon atoms, or fluoroalkyl having 3 to 21 carbon atoms and 1 to 10 oxygen atoms in its carbon chain (wherein no two oxygen atoms are present adjacent to each other).

6 Claims, No Drawings

FLUORINE-CONTAINING WATER-REPELLENT OIL-REPELLENT COMPOSITION

This application is a continuation of application Ser. No. 07/211,121, filed June 21, 1988, which is a division of Ser. No. 07/050,018, filed May 15, 1987, both now abandoned.

The present invention relates to fluorine-containing water- and oil-repellent compositions which exhibit good adhesion to the articles to be treated.

It is known that fluorine-containing polymers, such as some fluoroalkyl methacrylate polymers, are usable as water- and oil-repellent agents (see, for example, Examined Japanese Patent Publication SHO 47-40467). However, the known polymers having water- and oil-repellent properties have poor compatibility with the article to be treated and further have the problem that the coating of the polymer readily peels when lightly rubbed because of low adhesive strength.

The main object of the present invention is to provide a fluorine-containing water- and oil-repellent composition for giving uniform tough coatings exhibiting high adhesion to the article to be treated.

Other objects and features of the invention will become apparent from the following description.

The present invention provides a fluorine-containing water- and oil-repellent composition (hereinafter referred to as Composition (A) comprising a fluorine-containing polymer which comprises at least 10 mole % of a fluorine-containing acrylate represented by the formula:

$$CH_2{=}\underset{\underset{COO-Y-Rf}{|}}{C}-X \qquad (1)$$

wherein X is a fluorine atom or $-CFX^1X^2$ group (wherein $X^1$ and $X^2$ are the same or different and are each a hydrogen atom or fluorine atom), Y is alkylene having 1 to 3 carbon atoms, $-CH_2CH_2N(R)SO_2-$ group (wherein R is alkyl having 1 to 4 atoms) or $-CH_2CH(OZ)CH_2-$(wherein Z is a hydrogen atom or acetyl), and Rf is fluoroalkyl having 3 to 21 carbon atoms, or fluoroalkyl having 3 to 21 carbon atoms and 1 to 10 oxygen atoms in its carbon chain (wherein no two oxygen atoms are present adjacent to each other).

This invention further provides a fluorine-containing water- and oil-repellent composition (hereinafter referred to as Composition B) comprising a fluorine-containing polymer which comprises (i) 10 to 90 mole % of a monomer represented by the formula:

$$CH_2{=}\underset{\underset{COO-R^1}{|}}{C}-X^3 \qquad (3)$$

wherein $X^3$ is a fluorine atom, chlorine atom or $-CFX^4X^5$ group (wherein $X^4$ and $X^5$ are the same or different and are each a hydrogen atom or fluorine atom), and $R^1$ is alkyl having 1 to 20 carbon atoms, alicyclic group, aromatic group or aralkyl;

(ii) 10 to 80 mole % of a monomer represented by the formula:

$$CH_2{=}\underset{\underset{COO-Y-Rf^3}{|}}{C}-X^6 \qquad (4)$$

wherein $X^6$ is a hydrogen atom or methyl, Y is alkylene having 1 to 3 carbon atoms, $-CH_2CH_2N(R)SO_2-$group (wherein R is alkyl having 1 to 4 carbon atoms) or $-CH_2CH(OZ)CH_2-$(wherein Z is a hydrogen atom or acetyl), and $Rf^3$ is fluoroalkyl having 3 to 21 carbon atoms or fluoroalkyl having 3 to 21 carbon atoms and 1 to 10 oxygen atoms in its carbon chain (wherein no two oxygen atoms are present adjacent to each other); and (iii) 0 to 50 mole % of other copolymerizable ethylenically unsaturated monomer, the combined amount of the monomers (i) to (iii) being 100 mole %.

We prepared various fluorine-containing acrylate polymers and checked the polymers for adhesion to articles, consequently finding that polymers containing a specific acrylate has outstanding properties for use as a water- and oil-repellent agent. The present invention has been accomplished based on this novel finding.

The Rf group in the fluorine-containing acrylate (1) to be used in Composition A of the invention preferably contains a number of fluorine atoms at least twice the number of carbon atoms contained therein. More preferred examples of such Rf groups are those represented by the formula:

$$-((CF_2CF_2)_m(O)_n)_qCF(Rf^1)CF_3$$

wherein m is an integer of from 1 to 5, n is 0 or 1, q is an integer of from 1 to 5, and $Rf^1$ is a fluorine atom or trifluoromethyl, those represented by the formula $$-\underset{\underset{CF_3}{|}}{CFO}(CF_2\underset{\underset{CF_3}{|}}{CFO})_pCF(Rf^1)CF_3$$

wherein p is an integer of from 0 to 5 and $Rf^1$ is as defined above, or those represented by the formula:

$$-Ph-Rf^2$$

wherein Ph is phenylene, and $Rf^2$ is perfluoroalkyl having 5 to 15 carbon atoms.

More specific examples of monomers (1) are $CH_2{=}CF-COOCH_2CH_2C_7F_{15}$, $CH_2{=}CF-COOCH_2C_2F_5$, $CH_2{=}CF-COOCH_2C_8F_{16}CF(CF_3)_2$, $CH_2{=}CF-COOCH_2-CF(CF_3)OCF_2CF(CF_3)OC_3F_7$, $CH_2{=}CF-COOCH_2-CF(CF_3OC_3F_7$, $CH_2{=}CF-COOCH_2CH_2-N(CH_3)SO_2C_8F_{17}$, $CH_2{=}CF-COOCH_2CH(OH)CH_2C_9F_{19}$ and the like.

Examples of monomers, other than the fluorine-containing acrylate (1), which can be incorporated into the fluorine-containing polymer used in Composition A are monomers represented by the formula:

$$CH_2{=}\underset{\underset{COO-B}{|}}{\overset{\overset{A}{|}}{C}} \qquad (2)$$

wherein A is a hydrogen atom, chlorine atom or methyl and B is alkyl having 1 to 10 carbon atoms, fluoroalkyl having 1 to 10 carbon atoms, or alicyclic group having 6 to 8 carbon atoms. Also useful are other ethylenically unsaturated monomers including ethylene, propylene, styrene, and acrylates and methacrylates which have a functional group such as vinyl, hydroxyl, carboxyl, glycidyl, dialkylamino or trialkoxysilyl.

Examples of acrylates or methacrylates having a functional group are $CH_2{=}C(CH_3)COO(CH_2CH_2O)_{1\text{-}0}COC(CH_3){=}CH_2$, $CH_2{=}C(CH_3)COO(CH_2)_{1\text{-}0}COC(CH_3){=}CH_2$, $CH_2{=}C(CH_3)COOCH_2CH{-}(OCOC(CH_3){=}CH_2)CH_2OCOC(CH_3){=}CH_2$, $CH_2{=}CHCOOCH_2CH_2OH$, $CH_2{=}CHCOO\text{-}R^A$ (wherein $R^A$ is glycidyl), $CH_2{=}C(CH_3)COO{-}CH_2CH_2CH_2Si(OCH_3)_3$, etc.

More specific examples of monomers (2) are $CH_2{=}CHCOOCH_3$, $CH_2{=}CHCOOC_{12}H_{25}$, $CH_2{=}CHCOO{-}R^B$ (wherein $R^B$ is cyclohexyl), $CH_2{=}C(CH_3)COOCH_3$, $CH_2{=}C(CH_3)COOC_8H_{37}$, $CH_2{=}C(CH_3)COOCH_2CH_2C_7F_{15}$, $CH_2{=}C(Cl)COOCH_3$, etc.

The fluorine-containing polymer to be used for Composition A is usually in the range of from 10,000 to 4,000,000 in number average molecular weight (as measured by gel permeation chromatography) and in the range of from 0.25 to 2.0, in intrinsic viscosity [$\eta$](as measured at a temperature of 35° C. using m-xylene hexafluoride, methyl ethyl ketone, chloroform, 1,1,1-trichloromethane or like solvent). If the molecular weight is too small, the resulting coating has low strength and is liable to peel off the article treated, whereas if it is too great, the resulting composition is difficult to apply to articles owing to increased viscosity or low free-flowing properties.

The fluorine-containing polymer used in Composition A and comprising 10 to 90 mole % of a fluorine-containing acrylate (1), especially such an acrylate wherein X is a fluorine atom, exhibits high adhesion to the article to be treated, forming a tough and flexible coating.

The monomers represented by the formula (2) and inexpensive monomers, such as ethylene, propylene and styrene, are useful for reducing the cost of the fluorine-containing polymer and act to impart hardness to the fluorine-containing polymer. The monomers of the formula (2) and other monomers, such as ethylene, propylene and styrene, are used usually in an amount of up to 90 mole %.

The fluorine-containing polymer, when containing a functional group, exhibits improved adhesion to the article to be treated. Further the functional group can be utilized for crosslinking the fluorine-containing polymer. For the crosslinking, methods which are usually used in the art can be resorted to (see, for example, Unexamined Japanese Patent Publication SHO 47-42880). Usually up to 30 mole % of acrylate or methacrylate is used which has the functional group to be introduced into the fluorine-containing polymer.

Composition B comprising a fluorine-containing polymer which comprises 10 to 90 mole % of monomer represented by the formula (3), 10 to 80 mole % of monomer represented by the formula (4) and 0 to 50 mole % of other copolymerizable ethylenically unsaturated monomer also exhibits excellent water- and oil-repellent propoerties.

Examples of groups $R^1$ in the formula (3), which are not limited specifically, are alkyl groups such as methyl, ethyl, butyl and stearyl; halogenated (but not fluorinated) alkyl groups such as 2-chloroethyl; cycloalkyl groups such as cyclohexyl, bornyl and adamantyl; aromatic groups such as phenyl and naphthyl; silicon-containing groups such as trimethylsilyl and trimethylsilylpropyl; phosphorus-containing groups such as dimethylphosphateethyl; groups having an unsaturated bond such as allyl; groups having a functional group, such as cyanoethyl and glycidyl; groups having dialkylamino such as dimethylaminoethyl; groups having an ether group such as tetrahydrofurfuryl; etc.

More specific examples of monomers (3) are $CH_2{=}CFCOOCH_3$, $CH_2{-}CFCOOC_2H_5$, $CH_2{=}CFCOOC_3H_7$, $CH_2{=}CFCOOC_4H_9$ $CH_2{=}CFCOOCH(CH_3)_2$, $CH_2{=}CFCOOC_{12}H_{25}$, $CH_2{=}CFCOOC_{16}H_{37}$, $CH_2{=}CClCOOCH_2Cl$,

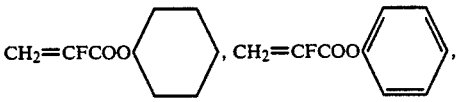

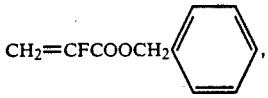

$CH_2{=}CClCOOCH_3$, $CH_2{=}CClCOOC_2H_5$, $CH_2{=}CClCOOC_3H_7$, $CH_2{=}CClCOOC_4H_9$, $CH_2{=}CClCOOCH(CH_3)_2$, $CH_2{=}CClCOOC_{12}H_{25}$, $CH_2{=}CClCOOC_{16}H_{37}$,

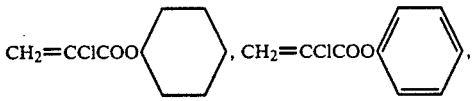

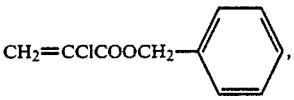

$CH_2{=}CClCOOCH_2CH_2OH$,

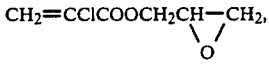

$CH_2{=}CClCOOCH_2Si(CH_3)_3$, $CH_2{=}CFCOOCH_2CH_2OP({=}O)(OCH_3)_2$, $CH_2{=}CClCOOCH_2CH_2CN$, $CH_2{=}CFCOOCH_2CH{=}CH_2$, etc.

The $Rf^3$ group in the fluorine-containing acrylate (4) to be used in Composition B in the invention preferably contains a number of fluorine atoms at least twice the number of carbon atoms contained therein. More preferred examples of such $Rf^3$ groups are those represented by the formula:

$$-((CF_2CF_2)_m(O)_n)_qCF(Rf^4)CF_3$$

wherein m is an integer of from 1 to 5, n is 0 or 1, q is an integer of from 1 to 5, and $Rf^4$ is a fluorine atom or trifluoromethyl, those represented by the formula $$-\underset{\underset{CF_3}{|}}{C}FO(CF_2\underset{\underset{CF_3}{|}}{C}FO)_pCF(Rf^4)CF_3$$

wherein p is an integer of from 0 to 5, and $Rf^4$ is as defined above, or those represented by the formula:

$$-Ph-Rf^5$$

wherein Ph is phenylene, and $Rf^5$ is perfluoroalkyl having 5 to 15 carbon atoms.

More specific examples of monomer (4) include $CH_2{=}CHCOOCH_2CH_2C_7F_{15}$, $CH_2{=}CHCOOCH_2C_2F_5$, $CH_2{=}C(CH_3){-}COOCH_2C_8F_{16}CF(CF_3)_2$, $CH_2{=}CHCOOCH_2CF(CF_3)OCF_2CF(CF_3)OC_3F_7$, $CH_2{=}C(CH_3)COOCH_2CF(CF_3)OC_3F_7$, $CH_2{=}CHCOOCH_2{-}CH_2N(CH_3)CO_2C_8F_{17}$, $CH_2{=}C(CH_3)COOCH_2CH(OH)CH_2C_9F_{19}$, $CH_2{=}CHCOOCH_2CH_2C_8F_{19}$, $CH_2{=}CHCOOCH_2CF(CF_3)OC_3F_7$, $CH_2{=}C(CH_3)COOCH_2CH_2C_7F_{15}$ and the like.

Examples of copolymerizable ethylenically unsaturated monomers, other than the monomers (3) and (4), which can be incorporated into the fluorine-containing polymer in Composition B include acrylates and methacrylates having a functional group such as vinyl, hydroxyl, carboxyl, glycidyl, dialkylamino or trialkoxysilyl, $CH_2{=}CH_2$,

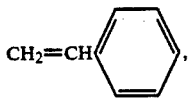

$CH_2{=}CHCH_3$, $CH_2{=}CHCOOCH_3$, $CH_2{=}C(CH_3)COOCH_3$,

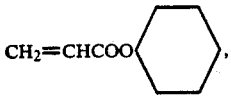

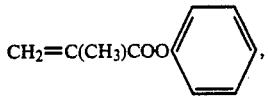

$CH_2{=}C(CH_3)COOC_{18}H_{37}$, $CH_2{=}CHCOOC_{12}H_{25}$,

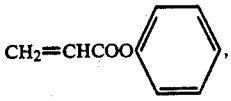

, etc.

The fluorine-containing polymer to be used for Composition B is usually in the range of from 10,000 to 4,000,000 in number average molecular weight (as measured by gel permeation chromatography) and in the range of from 0.25 to 3.0, preferably from 0.5 to 2.0, in intrinsic viscosity [η] (as measured at a temperature of 35° C. using m-xylene hexafluoride, methyl ethyl ketone, chloroform, 1,1,1-trichloromethane or like solvent). If the molecular weight is too small, the resulting coating has low strength and is liable to peel off the article treated, whereas if it is too great, the resulting composition is difficult to apply to articles owing to increased viscosity or low free-flowing properties.

The fluorine-containing polymer used in Composition B and comprising 10 to 90 mole % of an fluorine-containing acrylate (3), especially such an acrylate wherein $X^3$ is a fluorine atom or chlorine atom exhibits high adhesion to the article to be treated, forming a tough and flexible coating.

Composition B comprising a fluorine-containing copolymer containing 10 to 80 mole % of an acrylate (4) gives a coating excellent in water- and oil-repellent properties.

Other copolymerizable ethylenically unsaturated monomer, when incorporated into composition B, acts to impart improved hardness to the coating of composition.

The fluorine-containing polymers of the present invention can be prepared by radical polymerization (e.g. solution, bulk or emulsion polymerization) or anionic polymerization.

Examples of solvents useful for solution polymerization are fluorine-containing solvents such as m-xylene hexafluoride and trichlorotrifluoroethane, hydrocarbon solvents such as ethyl acetate, methyl isobutyl ketone, acetone, toluene and xylene, etc. The polymer obtained by solution polymerization can be used in the form of a solution which is prepared by separating the polymer from the solvent and dissolving the polymer in a solvent after drying, or in the form of a solution which is prepared by merely diluting the resulting reaction mixture.

The polymer obtained by bulk polymerization is usable as dissolved in a solvent after drying.

Examples of polymerization initiators useful for solution polymerization and bulk polymerization are azo compounds such as azobisisobutyronitrile, peroxide compounds such as benzoyl peroxide and the like.

For solution polymerization and block polymerization, mercaptans such as laurylmercaptan and thiphenol are usable as chain transfer agents.

In either of these two processes, the polymerization temperature is preferably 30 to 100° C.

Before application to the article to be treated, the fluorine-containing polymer prepared by solution or bulk polymerization is dissolved in a dissolving solvent capable of thoroughly dissolving the polymer and further diluting the solution with a diluting solvent capble of dissolving the polymer without permitting the dissolved polymer to separate out. Like usual water- and oilrepellent agents, the resulting composition is applied to the article by dipping, brushing, spraying or otherwise. Preferably the concentration of the composition is 0.1 to 30 wt.% for brush coating or about 0.05 to about 2 wt.% for spray coating. The coating is dried at room temperature to 150° C.

Examples of useful dissolving solvents are fluorine-containing solvents such as m xylene hexafluoride and trichlorotrifluoroethane, chlorine-containing solvents such as trichloroethane, etc. Examples of useful diluting solvents are chlorine-containing solvents such as tetrachloroethylene and trichloroethylene, ketone solvents such as acetone, ester solvents such as ethyl acetate, aromatic solvents such as toluene, etc. The dissolving solvent is usable also as the diluting solvent.

Nonionic compounds are desirable as emulsifiers for emulsion polymerization, while cationic emulsifiers are also usable.

The polymerization initiator to be used for emulsion polymerization is preferably a water-soluble compound. Examples of such compounds are azo compounds such as azobisisobutyroamidine hydrochloride, peroxide compounds such as succinic acid peroxide, etc. The emulsion polymerization temperature is preferably 30 to 100° C.

The fluorine-containing polymer prepared by emulsion polymerization is usable as an aqueous composition. Usually, the emulsifier need not be removed from the reaction mixture. The aqueous water- and oilrepellent composition is usable in the same manner as above. Since the aqueous composition contains water, it is desirable to heat the coating thereof at 100 to 150° C. for drying.

When the fluorine-containing acrylate of the formula (1) wherein X is trifluoromethyl is to be singly polymerized, it is preferable to resort to anionic polymerization in view of the velocity of polymerization.

Examples of polymerization initiators usable for anionic polymerization are alkali metals, metallic hydrides, sodium amide, Grignard reagents, metal alkyl, pyridine and the like.

Examples of solvents usable for anionic polymerization are aromatic solvents such as toluene, ether solvents such as tetrahydrofuran, etc.

Anionic polymerization is conducted usually in a high vacuum of about $1 \times 10^{-6}$ mm Hg or in a dry inert gas atmosphere. The polymerization temperature is usually −100 to 70° C.

The polymer prepared by anionic polymerization can be applied to the article to be treated in the same manner as the one prepared by solution polymerization.

The water- and oil-repellent composition of the present invention is usable for giving water- and oil-repellent properties to various solid articles which must be resistant to abrasion, such as tents, sheet covers, umbrellas, raincoats, shoes, caps to hats, bags, jackets, jumpers, aprons, blazers, slacks, skirts, other garments, carpets, sofas, curtains, etc. Further, the composition of the invention is useful as an agent for preventing the adhesion of liquid polymers such as epoxy resin.

The water- and oil-repellent composition of the invention comprises a polymer which contains as a component thereof a specific fluorine-containing acrylate having a fluorine atom or fluorine-containing group at the α-position. The present composition is superior to conventional water- and oil-repellent compositions in adhesion to the article to be treated and has high durability against laundry.

EXAMPLE 1

Into a 200-c.c. glass ampule were placed 50 g of a monomer represented by the formula: $CH_2{=}CF{-}COOCH_2CF(CF_3)OC_3F_7$ (hereinafter referred to as "αf6OF"), 4 g of glycidyl methacrylate (hereinafter referred to as "GMA"), 80 g of m-xylene hexafluoride (hereinafter referred to as "m-XHF") and 0.5 g of azobisisobutyronitrile, and the mixture was deaerated and purged with nitrogen repeatedly three times by the freeze-thaw method using methanol/dry ice. The ampule was then sealed off.

The ampule was immersed in a constant-temperature bath at 50° C. for 30 hours.

The reaction mixture was thereafter placed into petroleum ether, and the resulting precipitate of fluorine-containing polymer was dried, giving 52 g of a fluorine-containing polymer.

The polymer had an intrinsic viscosity [η] of 1.12 as measured at a temperature of 35° C. using m-XHF as a solvent.

Elementary analysis of the polymer revealed 30.2% of carbon and 54.4% of fluorine, indicating that the monomers had been polymerized almost entirely.

The polymer was dissolved in m-XHF (dissolving solvent) to a concentration of 30 wt.%, and the solution was diluted with trichlorotrifluoroethane (diluting solvent) to a concentration of 0.5 wt.%.

The dilution was applied to a synthetic leather comprising a polyurethane-coated nonwoven fabric, 3 mm in thickness, with a brush and then heated at 80° C. for 30 minutes to prepare a specimen for testing adhesion.

The contact angle of water, as well as n-hexadecane, with respect to the specimen was measured immediately after the preparation and after flexing the specimen through 120 degrees 10,000 times. Table 2 shows the results.

EXAMPLES 2–9 and COMPARATIVE EXAMPLES 1–3

Adhesion test specimens were prepared in the same manner as in Example 1 using the monomers, polymer dissolving solvent and diluting solvent listed in Table 1 for each polymer. Table 2 shows the results.

TABLE 1

| | Monomers and wt. ratio | [η] | Dissolving solvent | Diluting solvent |
|---|---|---|---|---|
| Example | | | | |
| 2 | αF6FO/MA/GMA = 66/30/4 | 0.98 | m-XHF | Trichloroethane |
| 3 | αF6FO/MA/GMA = 50/46/4 | 0.90 | m-XHF | Trichloroethane |
| 4 | αF6FO/MA/GMA = 28/77/5 | 0.91 | m-XHF | Trichloroethane |
| 5 | αF17F/CMS = 70/30 | 0.58 | Trichlorotrifluoroethane | Trichlorotrifluoroethane |
| 6 | αF17F/GMA = 90/10 | 0.62 | m-XHF | Trichlorofluoro ethane |
| 7 | αF17F/SA/17FA/GMA = 50/20/25/5 | 0.71 | m-XHF | Trichlorotrifluoroethane |
| 8 | αFi19F/MA/GMA 70/28/2 | 0.85 | m-XHF | Trichlorotrifluoro ethane |
| 9 | αFi19F/EGMA/MA/SMA = 25/2/58/15 | 0.41 | Trichloroethane | Trichlorotrifluoroethane |
| Comp. Ex. | | | | |
| 1 | 17FMA/SA/GMA = 50/45/5 | 0.35 | Trichloroethane | Trichlorotrifluoroethane |
| 2 | 17FA/GMA = 90/10 | 0.32 | m-XHF | Trichlorotrifluoroethane |
| 3 | 19FA/MA/GMA = 65/30/5 | 0.28 | m-XHF | Trichlorotrifluoroethane |

In Table 1 and in the following, the monomer representing symbols represent the following.

MA : $CH_2{=}CHCOOCH_3$

αF17F : $CH_2{=}CHCOOCH_2CH_2(CF_2CF_2)_3CF_2CF_3$

CMS : $CH_2{=}CH{-}Ph{-}CH_2Cl$ (wherein Ph is phenylene)

SA : $CH_2{=}CHCOOC_{18}H_{37}$

17FA : $CH_2{=}CHCOOCH_2CH_2C_8F_{17}$

αFi19F : $CH_2{=}CFCOOCH_2CH_2(CF_2CF_2)_3CF(CF_3)_2$

EGMA : $CH_2{=}C(CH_3)COO(CH_2CH_2O)_3COC(CH_3){=}CH_2$

SMA : $CH_2{=}C(CH_3)COOC_{18}H_{37}$

17FMA : $CH_2{=}C(CH_3)COOCH_2CH_2C_8F_{17}$

19FA : $CH_2{=}CHCOOCH_2CH_2C_9F_{19}$

TABLE 2

| | Contact angle (deg) As prepared/after flexing | |
|---|---|---|
| | Water | n-Hexadecane |
| Example 1 | 110/108 | 74/52 |
| Example 2 | 111/105 | 74/56 |
| Example 3 | 120/101 | 71/50 |
| Example 4 | 116/100 | 66/48 |
| Example 5 | 123/110 | 80/58 |
| Example 6 | 122/115 | 80/52 |
| Example 7 | 120/105 | 78/49 |
| Example 8 | 108/102 | 75/50 |
| Example 9 | 110/100 | 70/45 |
| Comp. Ex. 1 | 102/73.6 | 68/15 |
| Comp. Ex. 2 | 108/70 | 69/20 |
| Comp. Ex. 3 | 106/71 | 69/19 |

EXAMPLE 10

Water (1.9 liters), 400 g of acetone, 300 g of α F6OF, 19 g of MA, 1 g of EGMA and 40 g of an emulsifier (K220, product of Nippon Oils & Fats Co., Ltd.) were placed into a 3-liter four-necked flask equipped with a stirrer, thermometer, reflux condenser and dropping funnel and oxygen was removed from the system by introducing nitrogen thereinto. The flask was placed into a constant-temperature bath at 65° C. After the mixture was heated to a constant temperature, 0.1 liter of water having dissolved therein 1.6 g of azobisisobutyronitrile hydrochloride was added dropwise to the mixture to start polymerization.

Four hours later, a dispersion was obtained which contained 12 wt.% of solids. A portion of the dispersion was sampled and checked for monomer composition ratio and intrinsic viscosity [η]. The αF6OF/MA/EGMA ratio was 97.3/6/0.3 by weight (elementary analysis: 39.6% carbon and 55.0% fluorine) and the viscosity [η] was 0.68.

The dispersion was diluted with water to a concentration of 0.5 wt.% in a padding container. A polyester fabric was dipped in the padding bath, squeezed to remove the dilution, then dried at 80° C. for 3 minutes and heat-treated at 150° C. for 3 minutes to obtain a test specimen.

The specimen was tested for water repellency according to JIS L 1092 and for oil-repellency according to AATCC 118-1966T. The results were 100+and No.6, respectively.

The same specimen as above was washed under the conditions of bath ratio of 1:50 and temperature of 40° C. using a household electric washing machine and a detergent ("Super-Sabu", product of Kao Co., Ltd., Japan), then dried in air, lightly ironed at 140° C. and subjected to the two tests againing, giving the results of 100+and No.5, respectively.

COMPARATIVE EXAMPLE 4

Polymerization was conducted and a test specimen was prepared under the same conditions as in Example 10 with the exception of using 300 g of 17FA, 19 g of MMA and 1 g of EGMA as monomers. The polymer obtained was 0.38 in intrinsic viscosity [η].

Under the same conditions as in Example 10, the specimen was tested for water repellency and for oil repellency before and after laundry. The water repellency reduced from 100+to 70, and the oil repellency from No.3 to No.0.

EXAMPLE 11

Into a 200-c.c. glass ampule were placed 30 g of a monomer represented by the formula: $CH_2{=}CClCOOCH_3$, 20 g of a monomer of the formula: $CH_2{=}C(CH_3)COOCH_2CH_2C_8F_{17}$, 2 g of glycidyl methacrylate and 0.3 g of azobisisobutyronitrile, and the mixture was deaerated and purged with nitrogen repeatedly three times by the freeze-thaw method using methanol dry ice. The ampule was thereafter sealed off and immersed in a constant-temperature bath for 24 hours.

The reaction mixture was dissolved in 100 g of chloroform, and the mixture was placed into 2 liters of petroleum ether. The resulting precipitate was dried, giving 48 g of a fluorine-containing copolymer. The copolymer had an intrinsic viscosity [η] of 1.06 as measured at a temperature of 35° C. using chloroform as a solvent. Elementary analysis of the polymer revealed 37.4% of carbon, 17% of chlorine and 23.3% of fluorine, indicating that the monomers had been polymerized almost wholly.

The polymer was dissolved in chloroform (dissolving solvent) to a concentration of 5 wt.%, and the solution was diluted with 1,1,2-trichloro-1,2,2-trifluoroethane (diluting solvent) to a concentration of 0.5 wt.%.

Using the dilution, a specimen was prepared and tested for adhesion in the same manner as in Example 1. Table 4 shows the results.

EXAMPLES 12–15 and COMPARATIVE EXAMPLE 5

Adhesion test specimens were prepared in the same manner as in Example 11 using the monomers, dissolving solvent and diluting solvent listed in Table 3 for each polymer. The specimens were similarly tested with the results given in Table 4.

TABLE 3

| | Monomers and wt. ratio | [η] | Dis-solving solvent | Diluting solvent |
|---|---|---|---|---|
| Ex. 12 | αClS/17FMA/GMA = 50/45/5 | 1.0 | m-XHF | $CH_3CCl_3$ |
| Ex. 13 | αClCH/19FA/GMA = 30/66/4 | 0.98 | $CHCl_3$ | $CCl_2F{-}CClF_2$ |
| Ex. 14 | αFS/17FMA/GMA = 45/50/5 | 0.89 | m-XHF | $CH_3CCl_3$ |
| Ex. 15 | αClS/17FA/GMA = 70/25/5 | 1.31 | m-XHF | $CH_3CCl_3$ |
| Comp. Ex. 5 | 19FMA/MA/GMA = 65/30/5 | 0.68 | m-XHF | $CH_3CCl_3$ |

In Table 3, the monomer representing symbols mean the following monomers.

αClS : $CH_2{=}CClCOOC_{18}H_{37}$

αClCH: $CH_2{=}CClCOO$ 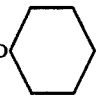

αFS : $CH_2{=}CFCOOC_{18}H_{37}$

17FMA : $CH_2{=}C(CH_3)COOCH_2CH_2C_8F_{17}$

19FA : $CH_2{=}CHCOOCH_2CH_2(CF_2CF_2)_3CF(CF_3)_2$

17FA : $CH_2{=}CHCOOCH_2CH_2C_8F_{17}$

19FMA : $CH_2{=}C(CH_3)COOCH_2CH_2(CF_2CF_2)_3CF(CF_3)_2$

αClMe : $CH_2{=}CClCOOCH_3$

TABLE 4

| | Contact angle (deg) As prepared/after flexing | |
|---|---|---|
| | Water | n-Hexadecane |
| Example 11 | 117/102 | 75/51 |
| Example 12 | 119/105 | 68/49 |
| Example 13 | 120/99 | 78/45 |
| Example 14 | 115/100 | 79/55 |
| Example 15 | 112/98 | 65/44 |
| Comp. Ex. 5 | 106/71 | 69/19 |

EXAMPLE 16

Into a 3-liter four-necked flask equipped with a stirrer, thermometer, reflux condenser and dropping funnel were placed I.9 liters of water, 400 g of acetone, 150 g of butyl α -chloroacrylate, 150 g of 17FMA, 1 g of EGMA and g of an emulsifier (K220, product of Nippon Oils & Fats Co., Ltd.), and oxygen was removed from the system by introducing nitrogen thereinto. The flask was placed into a constant-temperature bath at 65° C. After the mixture was heated to a constant temperature, 0.1 liter of water having dissolved therein 1.6 g of azobisisobutyronitrile hydrochloride was added dropwise to the mixture to start polymerization.

Four hours later, a dispersion was obtained which contained 12 2 wt.% of solids. A portion of the dispersion was sampled and checked for monomer composition ratio and intrinsic viscosity [η]. The butyl α-chloroacrylate/17FMA/EGMA ratio was 49.9/49.8/0.3 by weight (elementary analysis: 41.7% carbon, 10.9% chlorine and 30.2% fluorine) and the viscosity [η] was 0.50.

The dispersion was diluted with water to a concentration of 0.5 wt.% in a padding container. A polyester fabric was dipped in the padding bath, squeezed to remove the dilution, then dried at 80° C. for 3 minutes and heat-treated at 150° C. for 3 minutes to obtain a test specimen.

The specimen was tested for water repellency according to JIS L 1092 and for oil-repellency according to AATCC 118-1966T. The results were 100 and No.4, respectively.

The same specimen as above was washed under the conditions of bath ratio of 1:50 and temperature of 40° C using a household electric washing machine and a detergent ("Super-Sabu", product of Kao Co., Ltd., Japan,)then dried in air, lightly ironed at 140° C. and subjected to the above two tests with the results 90−and No.3, respectively.

COMPARATIVE EXAMPLE 6

Polymerization was conducted and a test specimen was prepared under the same conditions are in Example 16 with the exception of using 300 g of 17FA, 17 g of methyl methacrylate and 1 g of a monomer represented by the formula: $CH_2{=}C(CH_3)COO(CH_2CH_{20})_3COC(CH_3){=}CH_2$. The polymer obtained had an intrinsic viscosity [η]of 0.38.

Under the same conditions as in Example 16, the specimen was tested for water repellency and for oil repellency before and after laundry. The water repellency reduced from 100+to 70, and the oil repellency from No.3 to No.0.

EXAMPLE 17

One gram of the same fluorine-containing copolymer as used in Example 13 was dissolved in m XHF to a concentration 5 wt.%, and the solution was cast into a dish, 9 cm in diameter, and dried, giving a sheet, 100 μm in thickness.

The rupture strength and elongation of the sheet were measured by an autograph (product of Shimadzu Seisakusho Ltd.), with the results of 0.7 kgf/mm² and 320%, respectively.

COMPARATIVE EXAMPLE 7

A specimen was prepared and tested for rupture strength and elongation in the same manner as in Example 17 except that the fluorine-containing copolymer used in Example 11 was replaced by the polymer used in Comparative Example 5. The results were 0.26 kgf/mm² and 450%, respectively.

We claim:

1. A method of providing improved water- and oil-repellent properties to an article selected from the group consisting of textile and leather articles, the method comprising applying to said article a composition comprising a fluorine-containing polymer which comprises at least 10 mole % of a fluorine-containing acrylate represented by the formula:

$$CH_2{=}\underset{\underset{COO-Y-Rf}{|}}{C}-X \qquad (1)$$

wherein X is a fluorine atom or $-CFX^1X^2$ group wherein $X^1$ and $X^2$ are the same or different and are each a hydrogen atom or fluorine atom, Y is alkylene having 1 to 3 carbon atoms, $-CH_2CH_2N(R)SO_2-$ group wherein R is alkyl having 1 to 4 carbon atoms or $-CH_2CH(OZ)CH_2-$wherein Z is a hydrogen atom or acetyl, and Rf is fluoroalkyl having 3 to 21 carbon atoms, or fluoroalkyl having 3 to 21 carbon atoms and 1 to 10 oxygen atoms in its carbon chain wherein no two oxygen atoms are present adjacent to each other.

2. A method as defined in claim 1 wherein the group Rf in the fluorine-containing acrylate represented by the formula (1) is a group represented by the formula:

$$-((CF_2CF_2)_m(O)_n)_qCF(RF^1)CF_3$$

wherein m is an integer of from 1 to 5, n is 0 to 1, q is an integer of from 1 to 5, and $Rf^1$ is a fluorine atom or trifluoromethyl, those represented by the formula:

$$-\underset{\underset{CF_3}{|}}{CFO}(CF_2\underset{\underset{CF_3}{|}}{CFO})_pCF(Rf^1)CF_3$$

wherein p is an integer of from 0 to 5, and $Rf^1$ is as defined above, or those represented by the formula:

$$-Ph-Rf^2$$

wherein Ph is phenylene, and $Rf^2$ is perfluoroalkyl having 5 to 15 carbon atoms.

3. A method as defined in claim 1 wherein the composition comprises:

(i) 10 to 90 mole % of the fluorine-containing acrylate represented by the formula (1), and (ii) 90 to 10 mole % of an ethylenically unsaturated monomer.

4. A method as defined in claim 3 wherein the ethylenically unsaturated monomer is at least one of a monomer represented by the formula:

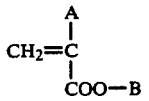

(2)

wherein A is a hydrogen atom, chlorine atom or methyl and B is alkyl having 1 to 20 carbon atoms, alicyclic group having 6 to 8 carbon atoms or fluoroalkyl having 1 to 10 carbon atoms; ethylene, propylene, styrene; and (metha)acrylate having vinyl, hydroxyl, carboxyl, glycidyl, dialkylamino or trialkoxysilyl.

5. A method as defined in claim 1 wherein the composition is in the form of a solution.

6. A method as defined in claim 1 wherein the composition is in the form of an aqueous dispersion.

* * * * *